United States Patent [19]

Williams

[11] 4,353,318

[45] Oct. 12, 1982

[54] SPRAY GUARD

[75] Inventor: Milton J. Williams, Richmond, Va.

[73] Assignee: Spray Guard Corporation, Richmond, Va.

[21] Appl. No.: 197,684

[22] Filed: Oct. 16, 1980

[51] Int. Cl.[3] ..... B63J 2/00

[52] U.S. Cl. ..... 114/211; 440/88; 220/85.5; 98/64; 98/2.17; 98/122

[58] Field of Search ..... 440/88, 113; 114/201 R, 114/211, 212, 173, 177, 178; 98/122, 8, 9, 32, 64; 220/855, 1 B, 366

[56] References Cited

U.S. PATENT DOCUMENTS

| | | | |
|---|---|---|---|
| 2,049,987 | 8/1936 | Willenborg | 220/855 |
| 3,422,982 | 1/1969 | Terwoerds | 220/366 |
| 3,895,467 | 7/1975 | Clement | 98/122 |
| 4,050,363 | 9/1977 | Fuerst | 98/64 |
| 4,084,531 | 4/1978 | Fujiura | 114/211 |

*Primary Examiner*—Trygve M. Blix
*Assistant Examiner*—D. W. Keen
*Attorney, Agent, or Firm*—Mason, Fenwick & Lawrence

[57] ABSTRACT

A molded plastic spray guard for a fuel tank vent head of a boat has an inner wall and an outer wall joined by a peripheral wall of U-shaped configuration with a slot extending forwardly from the rear edge of the inner wall to be fittable over a vent line adjacent the hull of a boat between the hull and vent head mounted on the end of the vent line which clamps the spray guard in position. The vent head is consequently protected against contact from spray resultant from operation of the boat to which it is connected but is capable of venting rearwardly through a rearwardly facing opening in the spray guard.

10 Claims, 7 Drawing Figures

Fig-1
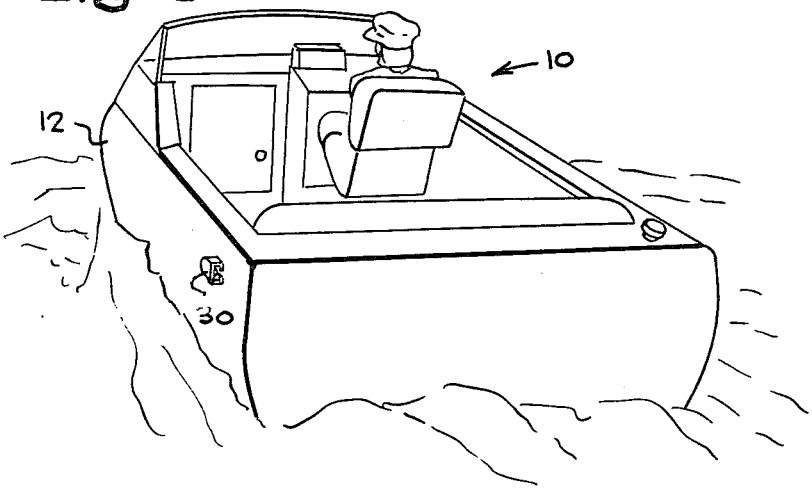
Fig-3
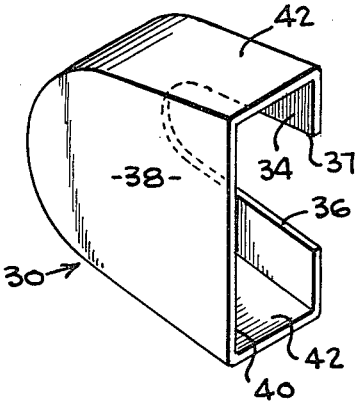
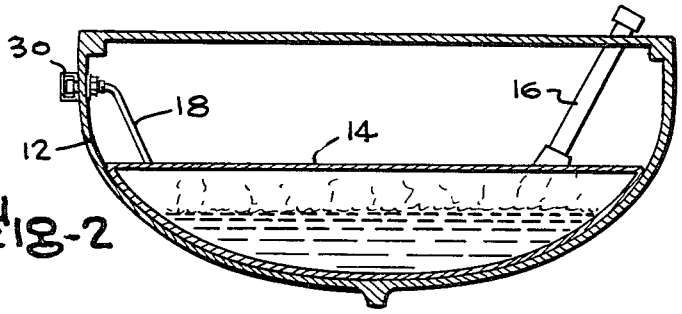
Fig-2
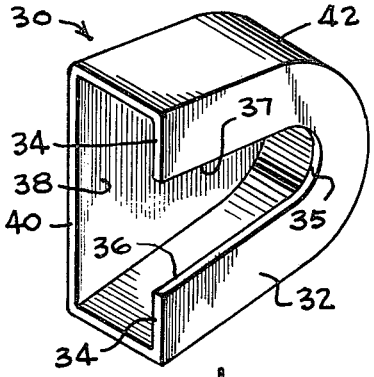
Fig-4
Fig-5
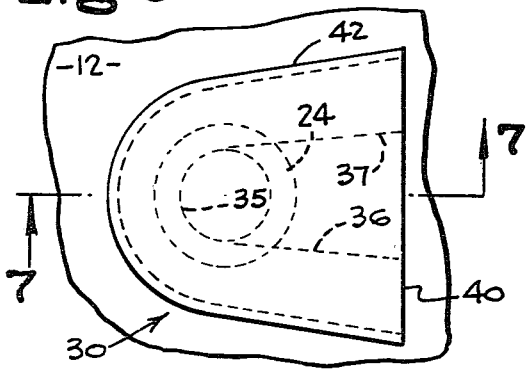
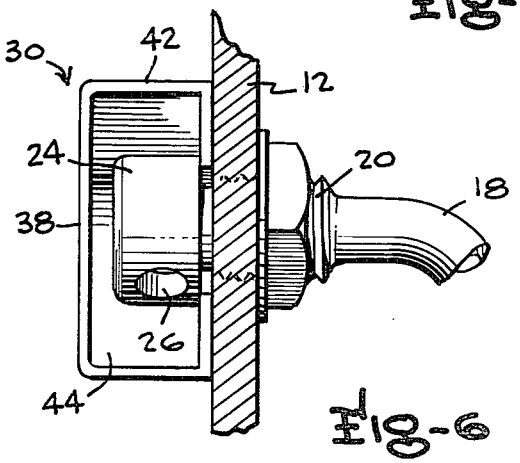
Fig-6
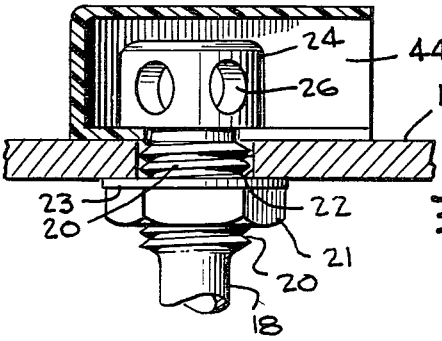
Fig-7

SPRAY GUARD

BACKGROUND OF THE INVENTION

Boats having internal fuel tanks must have a vent line connecting the upper portion of the interior of such tanks to atmosphere externally of the boat. It has been the practice in the past to provide an opening extending through the boat hull above the water line to which the vent line extends with a stop nut and washer engaging the inner side of the hull and a vent head being threaded on the outer side of the hull so that the vent line is fixedly held in position by the clamping of the hull between the stop nut and the vent head. The vent head is hollow to the extent that it has an internal axial bore extending partially along its length and which is connected to one or more radial bores providing the outlet passageway for the venting of fuel fumes to atmosphere. While vent heads of the foregoing type provide a fully satisfactory venting function, operation of the boat frequently permits the entry of spray into the radial passageways from which the spray particles migrate downwardly through the vent tube to the fuel tank so that there is an eventual accumulation of water in the bottom of the tank. The accumulation of water in the bottom of the fuel tank is obviously not desirable and necessitates the periodic drainage of the tank.

Therefore, it is the primary object of this invention to provide means for preventing the entry of spray into the vent head and vent line of a marine fuel tank.

SUMMARY OF THE INVENTION

Achievement of the foregoing objects is enabled by the preferred embodiment which comprises a spray guard comprising a unitary injection molded plastic member consisting of an inner wall and an outer wall oriented in parallel relationship and each having a U-shaped outer edge configuration. The inner wall and the outer wall are connected by a transverse wall extending between their edge portions with the rear termination of the transverse wall and the inner and outer walls lying in a common vertical plane. The inner wall has a forwardly extending U-shaped slot which is fittable over the outer end of a vent pipe externally of the hull of the boat in which the pipe is mounted. The forwardly extending U-shaped mounting slot is of less width than the diametric width of a vent head mounted on the outer end of the vent tube so that the inner wall can be clamped between the vent head and the outer surface of the hull. The vent head is completely enclosed within the confines of the inner wall, the outer wall and the transverse wall so that spray cannot strike the vent head during operation of the boat. However, the rear portion of the spray guard is open at an opening defined in the common plane defining the rear extent of the wall members so that the venting action to atmosphere is not impeded.

A better understanding of the manner in which the preferred embodiment achieves its intended purpose will be enabled when the following detailed description is considered in conjunction with the appended drawings in which like reference numerals are used with reference to the same parts in the different figures.

DESCRIPTION OF THE DRAWINGS

FIG. 1 is a perspective view of a boat illustrating the mounting of the preferred embodiment of the invention thereon;

FIG. 2 is a bisecting sectional view of the boat illustrating the relationship between the preferred embodiment and the boat components;

FIG. 3 is a perspective view of the preferred embodiment as viewed rearwardly and upwardly therefrom;

FIG. 4 is a perspective view of the preferred embodiment as viewed rearwardly and upwardly therefrom;

FIG. 5 is a side elevational view of the preferred embodiment as installed on a hull;

FIG. 6 is a rear elevation view of the preferred embodiment as installed on a boat hull which is shown in section; and FIG. 7 is a sectional view taken along lines 7—7 of FIG. 5.

DESCRIPTION OF THE PREFERRED EMBODIMENT

Attention is initially invited to FIGS. 1 and 2 which illustrate a boat 10 having a hull 12, an internal fuel tank 14, a fill tube 16 and a vent line 18. Vent line 18 is threaded at 20 and extends outwardly through an opening 22 provided in the hull 12 with a conventional vent head 24 being mounted on the threaded portion 20. A nut 21 and washer 23 are mounted on threaded portion 20 on the interior of the hull.

Vent head 24 includes an internal chamber and radial openings 26 which permit the outward flow of fumes or air from the tank 14 to permit the venting to atmosphere in a well-known manner. Prior to the present invention, the vent head 24 would simply be attached to the hull with the openings 26 extending so as to face rearwardly with the vent head engaging the side of the hull. However, normal operation of the boat would frequently result in spray entering the openings 26 for eventual movement to the bottom of the tank 14. The preferred embodiment of the present invention, generally designated 30, completely prevents the entry of spray.

The preferred embodiment 30 is unitarily formed of injection molded plastic and includes an inner wall 32 having a rear edge 34. A U-shaped slot is defined in inner wall 32 by linear surfaces 36 and 37 and an arcuate surface 35 with the slot extending forwardly and tapering inwardly as shown.

An outer wall 38 has a rear edge termination 40 which is coplanar with the rear edge termination 34 of the inner wall 32. Outer wall 38 is connected to the inner wall 32 by a transverse wall 42 extending perpendicularly to the plane of wall members 32 and 38 and being of U-shaped configuration.

It will be seen that the inner wall 32 and the outer wall 38 cooperate with the transverse wall 42 to define an internal chamber 44 which encloses the vent head 24. The slot defined by surface 36 tapers inwardly from front to rear but is of sufficient width to permit the slot to fit over the threaded portion 22 of the vent line 18. Nut 21 threaded on the surface 20 of the line 18 engages washer 23 so that tightening of the nut clamps the inner wall 32 between the vent head 24 and the outer surface of the hull 12 in an obvious manner. Since the spray head faces with its rearward opening to the stern of the boat, it is impossible for the spray resultant from operation of the boat to enter the vent head 24 via opening 26. Consequently, the present invention completely eliminates the problem of spray entry into the vent line so as to constitute a valuable advance in the art.

Numerous modifications of the preferred embodiment will undoubtedly occur to those of skill in the art; and for example, it is not necessary that the invention be formed of plastic or that it be injection molded. In fact, the spray guard could be formed of a wide variety of materials and the invention is not limited to the exact configuration shown in the drawings. It should therefore be understood that the spirit and scope of the invention is to be limited solely by the appended claims.

I claim:

1. A spray guard for preventing the entry of spray into the vent head on the end of a fuel vent line of a boat comprising a unitary member having a forward end and a rearward end and including an inner wall having a planar hull engaging surface and a rear edge, an outer wall spaced from the inner wall and transverse wall means extending between and connecting the inner wall to the outer wall to define a chamber of sufficient size to receive and enclose a vent head on the end of a vent line, a rearwardly facing opening in said chamber, a mounting slot having linear side edges extending inwardly from the rear edge of the inner wall and being of sufficient width to permit the vent line to extend therethrough but being of less width than the vent head to permit the vent head to clampingly engage the inner wall between the vent head and the hull of a boat so that the planar hull engaging surface is clamped against the hull to hold the spray guard in position permitting venting through the rearwardly facing opening while precluding contact of spray resultant from operation of the boat with the vent head so as to prevent the entry of such spray into the vent head and vent line.

2. The spray guard of claim 1, wherein said mounting slot is of U-shaped inwardly tapering from rear to front configuration.

3. The spray guard of claim 2, wherein said transverse wall means comprises a U-shaped panel.

4. The spray guard of claim 3, wherein said inner wall and said outer wall are in parallel planes.

5. The spray guard of claim 4, wherein the rear termination of the transverse wall means, the rear termination of the outer wall and the rear edge of the inner wall are all positioned in a common plane.

6. The spray guard of claim 1, wherein said unitary member is formed of plastic material.

7. The spray guard of claim 6, wherein said mounting slot is of U-shaped inwardly tapering configuration defined by said linear side edges and an arcuate surface merging with the forward ends of the linear side edges.

8. The spray guard of claim 7, wherein said transverse wall means comprises a U-shaped panel.

9. The spray guard of claim 8, wherein said inner wall and said outer wall are positioned solely in parallel planes.

10. The spray guard of claim 9, wherein the rear termination of the transverse wall means, the rear termination of the outer wall and the rear edge of the inner wall are all positioned in a common plane.

* * * * *